United States Patent [19]

Hazel

[11] Patent Number: 4,512,398

[45] Date of Patent: Apr. 23, 1985

[54] PUMP-OUT PLUG CATCHER

[75] Inventor: James A. Hazel, Corsicana, Tex.

[73] Assignee: Standard Oil Company, Chicago, Ill.

[21] Appl. No.: 512,292

[22] Filed: Jul. 8, 1983

[51] Int. Cl.[3] ..... E21B 31/08

[52] U.S. Cl. ..... 166/70; 166/99; 166/242

[58] Field of Search ..... 166/70, 117, 164, 376, 166/386, 242, 69, 99, 318, 155, 205, 162, 196, 317; 175/308, 312; 137/67, 68 R; 285/197

[56] References Cited

U.S. PATENT DOCUMENTS

| | | | |
|---|---|---|---|
| 2,415,608 | 2/1947 | Santiago | 166/164 |
| 2,599,386 | 6/1952 | Haynes | 166/70 |
| 4,099,563 | 7/1978 | Hutchison et al. | 166/317 |
| 4,182,419 | 1/1980 | Yeates | 166/318 |
| 4,257,628 | 3/1981 | Peterson | 285/197 |
| 4,338,999 | 7/1982 | Carter, Jr. | 166/117 |

*Primary Examiner*—James A. Leppink
*Assistant Examiner*—Hoang C. Dang
*Attorney, Agent, or Firm*—Scott H. Brown; Fred E. Hook

[57] ABSTRACT

A pump-out plug catcher is disclosed for use within a wellbore to contain a released pump-out plug. The catcher includes a body, pump-out plug retention devices, and an extension member which extends into the body. The body is provided with an axial bore extending therethrough and an enlarged hollow portion in communication with the bore. Pump-out plug retention devices are provided in an upper portion of the body and retain a pump-out plug across the bore until subjected to a predetermined pressure. The extension member is provided with an axial bore extending therethrough which is of a diameter less than pump-out plug. The released pump-out plug catcher apparatus is lowered into a wellbore and set below a retrievable packer assembly. A pump-out plug is connected to the catcher and fluid is introduced down the tubing to force the pump-out plug from its position. The pump-out plug then falls into and is retained in the enlarged hollow portion of the body, thereby allowing for the unrestricted free passage of fluids and objects through the pump-out plug catcher.

8 Claims, 1 Drawing Figure

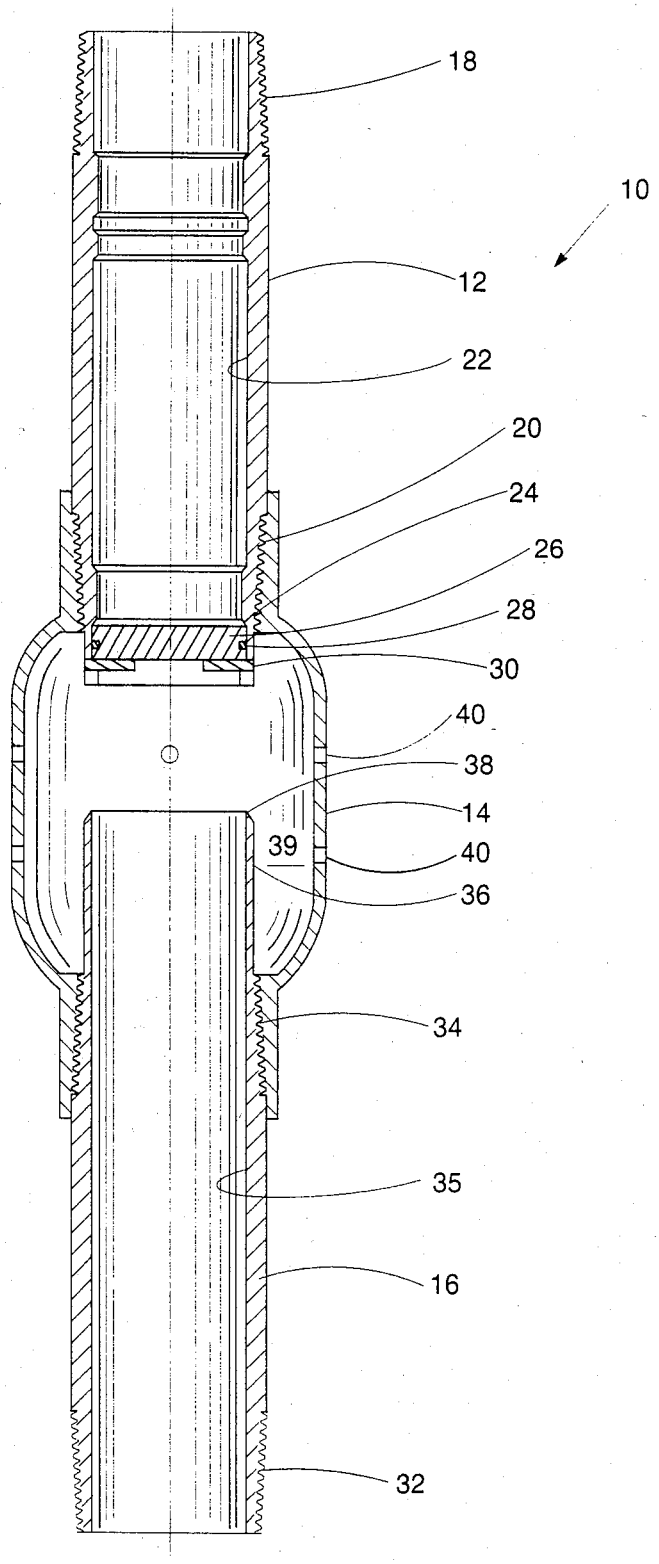
18
10
12
22
20
24
26
28
30
40
38
14
39
40
36
34
35
16
32

PUMP-OUT PLUG CATCHER

BACKGROUND OF THE INVENTION

1. Field of the Invention

The present invention relates to devices used in well completions and, more particularly, to a device to prevent a pump-out plug which has been released from interfering with well completion operations.

2. Setting of the Invention

After a wellbore has been drilled, various wellbore completion operations can be initiated to make the wellbore suitable for production of hydrocarbons or the like. In certain situations it is desirable for the wellbore to be completed so fluids from two or more producing zones can be commingled and removed together from the wellbore. When the two fluids are to be produced the producing zones can segregated by at least one retrievable bridge plug assembly which is set within the wellbore between the two producing zones by a wireline or set via a tubing string. When completing a wellbore in this manner a packer assembly with a pump out plug can be used to isolate formation pressures in the wellbore from the surface so the tubing can be run into the wellbore freely without having to overcome the force of the bottomhole reservoir pressure. The packer assembly generally consists of a packer and a seating nipple with a removable pump out plug seated in the nipple.

When the bridge plug assembly is to removed from the wellbore, a tubing string is lowered into the wellbore and connected to a threaded neck of the bridge plug assembly and then is removed. While this operation is usually simple and efficient, problems can arise in retrieving the bridge plug when packer assembly is set above the retrievable bridge plug assembly. In this case, a tubing string is connected to the packer, and fluid is introduced through the tubing to force the pump-out plug out from the packer assembly so fluid communication can be established. However, the released pump-out plug needs to be removed from the wellbore, before the retrievable bridge plug assembly can be removed from the wellbore, so it will not interfere with the flow of fluids through the wellbore and to not interfere with the removal of the bridge plug assembly. To retrieve the pump-out plug requires what is commonly called a "fishing job" whereby a special tool is lowered into the wellbore to retrieve the pump-out plug. If the pump-out plug cannot be retrieved in this manner then the pump-out plug has to be milled out by a special milling tool. There exists a need for a device to contain the pump-out plug for ease of retrieval to eliminate the time consuming and costly fishing and/or milling operations.

Various devices have been developed for capturing and containing objects which are released within a wellbore. One such device is described in U.S. Pat. No. 4,182,419 to Yeates, which discloses a downhole surge tool. The surge tool includes a tubular nipple, a surge plug inserted into the nipple, and a catcher subassembly. The catcher subassembly is connected to a lower portion of the nipple and consists of a conventional bull plug with a plurality of fluid communication channels therethrough. When the surge plug in the nipple is displaced by fluid pressure or the like, it falls into the catcher subassembly and there does not interfere with fluid flow in the well. Nowhere is it disclosed or suggested within Yeates to have a plug catcher device which has a bore extending completely therethrough to allow for the free flow of fluids and other objects, such as logging tools and the like, through the device.

Another device designed to capture and contain objects which are released within a wellbore is described in U.S. Pat. No. 4,338,999 to Carter, which discloses a knockout pin trap. The knockout pin trap is mounted in a well casing above a float valve and catches pins falling from the casing installation packers as the pins are broken off by a cementing plug descending into the wellbore. The knockout pin trap consists of a cylindrical hollow body mounted above a float valve and has a plurality of rods extending laterally across its bore and a collapsible pin chute or guide mounted on top of the body to guide the pins into the body. Nowhere is it disclosed or suggested within Carter to have a pump-out plug catcher apparatus which has a bore extending therethrough and which allows the free flow of fluid and objects, such as logging tools and the like, through the apparatus.

SUMMARY OF THE INVENTION

The present invention is a pump-out plug catcher apparatus designed to overcome the foregoing disadvantages. The pump-out plug catcher apparatus of the present invention is utilized in a wellbore to isolate zones of different formation pressures and comprises a body which has a first bore extending axially therethrough. An enlarged hollow body is connected to the body and is in communication with the first bore. A pump-out plug retention device is provided in the body and is used for retaining a pump-out plug across the first bore until subjected to a predetermined pressure. An extension member is provided in the lower portion of the body and extends into the enlarged hollow portion body. A second bore extends axially through the extension member and is of a diameter less than the pump-out plug.

In one embodiment of the present invention, the first and second bores are coaxially. When the pump-out plug is subjected to a pressure greater than its predetermined release pressure, it falls into the enlarged hollow portion of the body and since it is of a larger diameter than the second bore through the extension member, is retained in the void between the extension member and the interior walls of the enlarged hollow portion body. With the first and second bores coaxially aligned, fluids and objects such as logging tools and the like, can freely pass through the apparatus.

BRIEF DESCRIPTION OF THE DRAWINGS

FIG. 1 is a cross-sectional view of a pump-out plug catcher apparatus embodying the present invention.

DETAILED DESCRIPTION OF THE PREFERRED EMBODIMENTS

The present invention comprises a pump-out plug catcher apparatus which has a body with a first bore extending axially therethrough, an enlarged hollow body connectable to the body and in communication with the first bore. A pump-out plug retention device is provided in the body for retaining a pump-out plug across the first bore until subjected to a predetermined pressure. An extension member is connected to and extends into the enlarged hollow body. The extension member has a second bore extending axially therethrough and is of a diameter less than the pump-out plug.

As shown in FIG. 1, the pump-out plug apparatus 10 includes a plug holder nipple 12, an enlarged hollow member or a plug catcher 14, and a plug deflection nipple 16, all of which are operatively connected together as will be discussed below.

The plug holder nipple 12 is provided with conventional threaded tubing connections 18 in an upper portion thereof for interconnection with a tubing string (not shown), and threaded connections 20 in a lower portion thereof for interconnection with the plug catcher 14. A bore 22 extends axially through the plug holder nipple 12, and a lower portion of the plug holder nipple 12 is provided with an annular nipple seat wherein a pump-out plug 26 is retained. The pump-out plug 26 can be any conventional wellbore releasable plug used to prevent fluid passage through the nipple The pump-out plug 26 often will include an annular gasket or O-ring 28, as is common in the art. The pump-out plug 26 can be formed from any suitable material, such as iron, steel, aluminum or the like.

The pump-out plug 26 is retained against the annular shoulder 24 by a plurality of removable shear pins 30 which extend through holes (not shown) in the nipple 12 and extend partway across the bore 22. The pins 30 can be formed of any suitable material, most commonly brass, and each has a predetermined shear strength. For example, each of four pins 30 can have a shear strength of 250 psi for a total shear release pressure of the pump-out plug 26 of 1000 psi. Other plug retention devices can be utilized, such as latches or the like.

The plug deflector nipple 16, which can be formed from a conventional tubing seating nipple, is provided with threaded connections 32 on a lower portion thereof for interconnection with a packer (not shown) or other wellbore tubing device, and threaded connections 34 on an upper portion thereof for interconnection with the plug catcher 14. A bore 35 extends through the deflector nipple 16 and is coaxial with the bore 22 in the plug holder nipple 12. A tubular extension member 36 extends from an upper portion of the plug deflector nipple 16 and is provided with a bore 38 extending axially therethrough.

The plug catcher 14 is provided with conventional threaded connections on an upper and lower portion thereof, as described above, for connection to the plug seating nipple 12 and the plug deflector nipple 16. The plug catcher 14 is basically a hollow body 39 with an interior diameter of a larger diameter than the exterior diameter of the nipples 12 and 16. The hollow body 39 of the plug catcher 14 is provided with a plurality of fluid bypass openings 40. The plug catcher 14 can be formed from conventional wellbore equipment such as from two milled bull plugs welded end-to-end with one-half of a milled, threaded tubular collar welded to each end so that the collars are coaxially aligned.

The assembly of the pump-out plug catcher apparatus 10 is as follows. The pump-out plug 26 is inserted into the plug holder nipple 12 and landed against the shoulder 24 and is retained a plurality by shear pins 30 of the desired shear strength. The plug holder nipple 12, with the pump-out plug 26 held in place, is screwed into the top end of the plug catcher 14. The plug deflector nipple 16 then is screwed into the bottom end of the plug catcher 14 so that the extension member 36 is spaced below the pump-out plug 28.

In certain operations it is foreseeable that the bore 38 of the extension member 36 does not necessarily have to be coaxial or of the same diameter as the bore 22 of the plug holder nipple 12; however, when objects, such as logging tools and the like, are desired to be lowered through the pump-out plug catcher apparatus 10 (after the pump-out plug 26 has been released) then the bores 22 and 38 should be coaxial in alignment.

The operation of the pump-out plug catcher 10 is as follows. The pump-out catcher 10 is lowered into a wellbore on a wireline or on a tubing string along with a packer assembly threadedly connected to the threads 32. The producing formation below the packer assembly and the pump-out plug catcher 10 is isolated after the packer is set, as is well known in the art. A tubing string is then lowered into and connected to the packer and fluid is introduced down the tubing string when the pressure on the pump-out plug 26 exceeds the combined shear force of the pins 30 so the pump-out plug 26 is released. The plug 26 falls against the top lip of the extension member 36 and since the pump-out plug 26 is larger in diameter than the bore 38 through the extension member 36, the plug 26 slides off the extension member 36 and falls into the void between the extension member 36 and the interior wall of plug catcher 14.

By use of the present invention, the "fishing" trip used to retrieve the released pump-out plug, which can cost up to $1000 and $2000, is eliminated. Also, there is no risk of having to mill out a lost pump-out plug, which can cost up to $50,000.

Whereas the present invention has been described in particular relation to the drawings attached hereto, it should be understood that other and further modifications, apart from those shown or suggested herein, many made within the scope and spirit of the present invention.

What is claimed is:

1. A pump-out plug catcher comprising:

a body having a first bore extending axially therethrough;

an enlarged hollow body connectable to said body and in communication with said first bore;

a pump-out plug retention means provided in said body for retaining a pump-out plug across said first bore until subjected to a predetermined fluid pressure; and an extension member rigidly connectable to and extending into said enlarged hollow body, for retaining a released pump-out plug said extension member having a second bore extending axially therethrough and of a diameter less than said pump-out plug.

2. A pump-out plug catcher of claim 1 wherein said body includes a plurality of threaded connection means for interconnection with a tubing string or the like.

3. A pump-out plug catcher of claim 1 wherein said pump-out plug retention means comprises a plurality of shear pins.

4. A pump-out plug catcher of claim 1 wherein said first and said second bores are coaxially aligned.

5. A pump-out plug catcher of claim 1 wherein said enlarged hollow body comprises an elongated tubular housing removably connected to said body and said extension member.

6. A pump-out plug catcher of claim 4 wherein said first and said second bores provide an unrestricted passage for fluids and objects through said pump-out plug catcher.

7. A pump-out plug catcher for interconnection with a tubing string, comprising:

a body having a first bore extending axially there through;

an enlarged hollow body connectible to said body and in communication with said first bore;

a pump-out plug retention means provided in a lower portion of said body for retaining a pump-out plug across said first bore until subjected to a predetermined fluid pressure; and an extension member rigidly connectable to and extending into said enlarged hollow body for retaining a released pump-out plug, said extension member having a second bore extending axially there through coaxial with said first bore and of a diameter less than said pump-out plug.

8. A pump-out plug catcher for interconnection with a packer assembly used to isolate a formation interval, comprising:

a body having a first bore extending axially there through;

an enlarged hollow body connectable to said body and in communication with said first bore;

a pump-out plug retention means provided in a lower portion of said body for retaining a pump-out plug across said first bore until subjected to a predetermined fluid pressure; and an extension member rigidly connectable to and extending into said enlarged hollow body for retaining a released pump-out plug, said extension member having a second bore extending axially therethrough, coaxial with said first bore and of a diameter less than said pump-out plug, wherein said first and said second bores provide an unrestricted passage for fluids and objects through said pump-out plug catcher.

* * * * *